US006181291B1

(12) United States Patent
Anderson et al.

(10) Patent No.: US 6,181,291 B1
(45) Date of Patent: Jan. 30, 2001

(54) STANDING WAVE ANTENNA ARRAY OF NOTCH DIPOLE SHUNT ELEMENTS

(75) Inventors: Joseph M. Anderson; Pyong K Park, both of Tucson, AZ (US)

(73) Assignee: Raytheon Company, Lexington, MA (US)

( * ) Notice: Under 35 U.S.C. 154(b), the term of this patent shall be extended for 0 days.

(21) Appl. No.: 09/275,585

(22) Filed: Mar. 24, 1999

(51) Int. Cl.[7] ..... H01Q 21/00; H01Q 13/10
(52) U.S. Cl. ..... 343/816; 343/770; 343/771
(58) Field of Search ..... 343/770, 771, 343/772, 816, 864, 767, 700 MS, 756, 909, 795, 801, 809; 333/21 A, 137

(56) References Cited

U.S. PATENT DOCUMENTS 5,023,623 * 6/1991 Krienheder et al. ..... 343/770
5,579,019 * 11/1996 Uematsu et al. ..... 343/771
6,043,785 * 3/2000 Marino ..... 343/767

* cited by examiner

*Primary Examiner*—Tan Ho
(74) *Attorney, Agent, or Firm*—David W. Collins; Glenn H. Lenzen, Jr.

(57) ABSTRACT

A compact high-performance antenna. The antenna includes a waveguide (16) for providing or receiving electromagnetic energy. A feed circuit (18, 106, 108, 110) provides or receives the electromagnetic energy to or from the waveguide (16). A radiating circuit (112, 114) provides or receives the electromagnetic energy to or from the feed circuit (18). One or more notches (120) in the feed circuit (108, 110) compensate for insertion phase errors in the electromagnetic energy. One or more tabs (18) in the radiating circuit (112, 114) compensate for radiation phase errors in the electromagnetic energy. In a specific embodiment, the antenna is a dipole antenna and includes an array of dipole cards. The radiating circuit (112, 114) includes first (112) and second (114) radiating circuits included in each of the dipole cards (14). The first (112) and second (114) radiating circuits include a plurality of quarter-wave stripline transformers (24). The transformers (24) include one more rectangular tabs (18) for tuning out radiation phase errors, capacitance effects, and/or junction effects. The feed circuit (108, 110) includes v-shaped notches (120) near the bases of the transformers that compensate for insertion phase errors. In the illustrative embodiment, the transformers (24) are arranged so that an equivalent circuit of the radiating circuit (112, 114) appears shunt to an equivalent circuit of the feed circuit (18, 106, 108, 110). Each transformer (24) is connected to a slotline radiating element (116). The magnitude of the transmitted or received electromagnetic energy is a function of the sizes of the transformers (24). The feed waveguide (16) includes indentations for inductive tuning.

28 Claims, 3 Drawing Sheets

STANDING WAVE ANTENNA ARRAY OF NOTCH DIPOLE SHUNT ELEMENTS

BACKGROUND OF THE INVENTION

1. Field of Invention

This invention relates to antennas. Specifically, the present invention relates to stripline fed dipole antennas and their associated transformers.

2. Description of the Related Art

Antennas are used in a variety of demanding applications ranging from cellular telecommunications systems to missile systems. Such applications often require very compact antennas that are easily tuned for certain signal environments.

Compact, tunable antenna designs are particularly important in military applications employing antennas for missile guidance. The antennas must often fit in very compact spaces such as radomes. The weight and space requirements of the antenna add design constraints to the missile thereby increasing system cost and may compromise performance.

Often, the antennas are tuned for different signal environments and/or to meet different system requirements such as phase error or antenna sidelobe specifications. To tune a typical dipole missile seeker antenna, the lengths of transformers and feed lines in the antenna are adjusted. The adjustments typically increase the space occupied by the antenna and result in undesirable antenna protrusion into the radome. The excess protrusion may result in less antenna aperture and a corresponding degradation in antenna performance. In addition, the line length adjustments are often ineffective at tuning out junction effects. As a result, in high frequency applications such as Ka band applications, where junction effects can be significant, transformer length adjustments are often ineffective. In addition, line length extension may result in undesirable electrical coupling between feed lines. The coupling may result in undesirable changes to sidelobe levels, null depths, and/or gain losses and a corresponding overall decrease in performance.

Hence, a need exists in the art for a compact tunable antenna for achieving maximum performance while occupying minimal space that is applicable to high frequency applications such as Ka band applications.

SUMMARY OF THE INVENTION

The need in the art is addressed by the compact high-performance antenna of the present invention. The inventive antenna includes a waveguide for providing or receiving electromagnetic energy. A feed circuit provides or receives the electromagnetic energy to or from the waveguide. A radiating circuit provides or receives the electromagnetic energy to or from the feed circuit. One or more notches in the feed circuit compensate for insertion phase errors in the electromagnetic energy. One or more tabs in the radiating circuit compensate for radiation phase errors in the electromagnetic energy.

In a specific embodiment, the antenna is a dipole antenna and includes an array of dipole cards. The radiating circuit includes first and second radiating circuits included in each of the dipole cards. The first and second radiating circuits include a plurality of quarter-wave stripline transformers. The transformers include one more rectangular tabs for tuning out radiation phase errors, capacitance effects, and/or junction effects. The feed circuit includes v-shaped notches near the bases of the transformers that compensate for insertion phase errors.

In the illustrative embodiment, the transformers are arranged so that an equivalent circuit of the radiating circuit appears shunt to an equivalent circuit of the feed circuit. Each transformer is connected to a slotline radiating element. The magnitude of the transmitted or received electromagnetic energy is a function of the sizes of the transformers. The feed waveguide includes indentations for inductive tuning.

The novel design of the present invention is facilitated by the use of a combination of notches and tabs that allow for effective adjustments of antenna radiating characteristics without the need for expanding the size of the antenna via the extension of transformer line lengths.

DESCRIPTION OF THE INVENTION

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Figure 1:
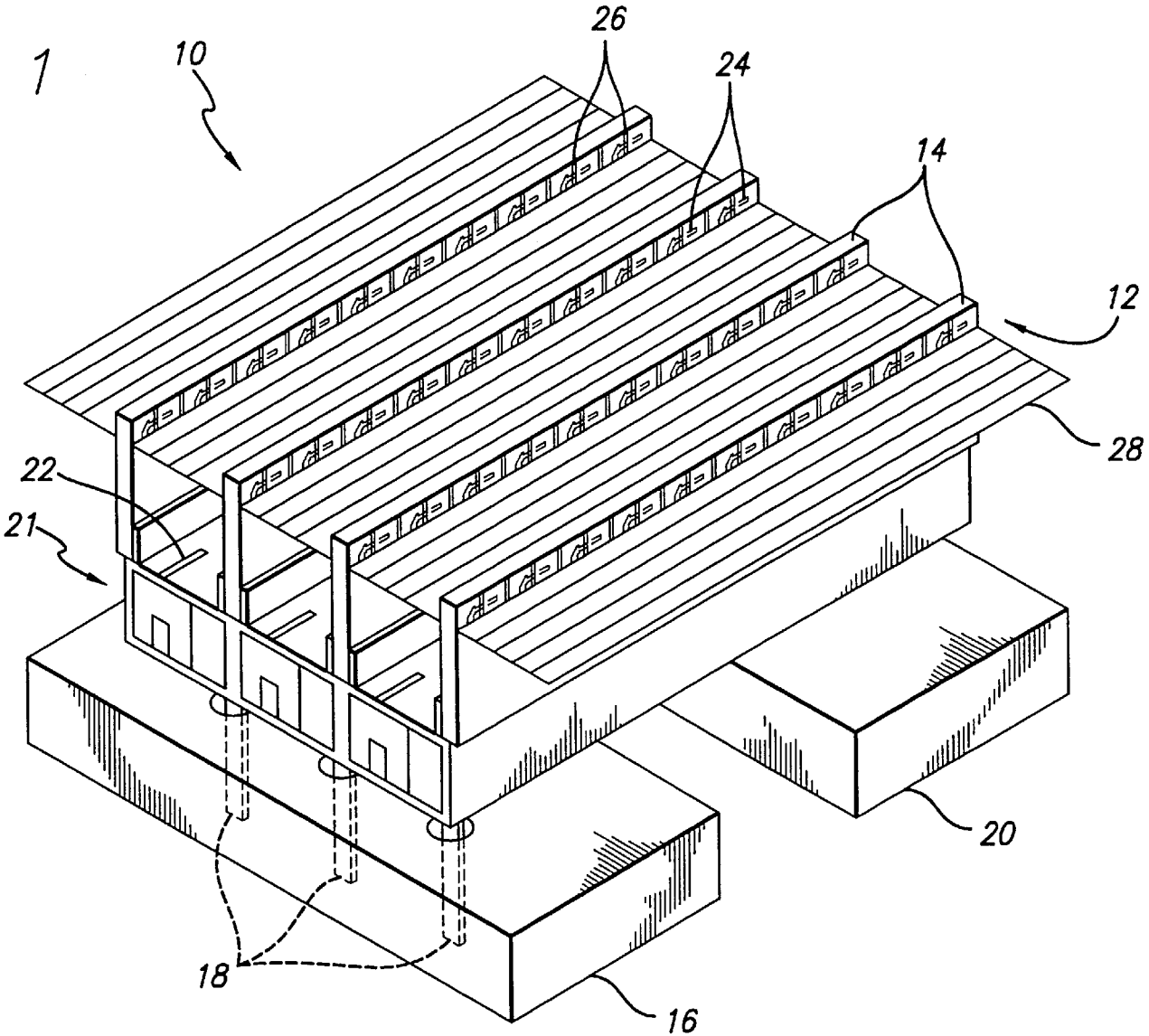
FIG. 1 is a diagram of the antenna of the present invention showing an array of dipole cards.

FIG. 1 is a diagram of the antenna 10 of the present invention showing an array 12 of dipole cards 14. Each dipole card 14 in the array 12 is positioned perpendicular to a rectangular feed waveguide 16 that feeds each dipole card 14. The feed waveguide 16 is coupled to the dipole cards 14 via stripline coupling probes 18. A rectangular slot feed guide 20 is positioned parallel to the feed waveguide 16 and is connected to iris fed centered longitudinal slots 22 positioned parallel to and between the dipole cards 14. Each dipole card 14 includes circuitry (as discussed more fully below) including a plurality of transformers 24. Radiating slots 26 in the dipole cards 14 centered over the transformers 24 facilitate radiation of electromagnetic energy from the transformers 24. A polarizer ground plane 28 is positioned perpendicular to the dipole cards 14 and near the tops of the dipole cards 14 to reduce sidelobe levels and improve the overall performance of the antenna 10.

In the present specific embodiment, the dipole cards 14 are constructed of stripline boards spaced 0.7 $\gamma$ apart, where $\gamma$ is the wavelength of electromagnetic to be radiated or received. The stripline boards are constructed of a bonded assembly of two 15 millimeter thick duroid boards.

The stripline fed dipole array 12 can efficiently receive or transmit Ka band electromagnetic energy. The antenna 10 includes, in addition to the dipole array 14, an iris excited slotted waveguide array 21. The iris excited slotted waveguide array 21 is fed by the slot feed guide 20. A more detailed discussion of the iris excited slotted waveguide array is presented in U.S. patent application Ser. No. 09/058, 112, filed Apr. 9, 1998, by Pyong K Park et al., entitled CENTERED LONGITUDINAL SHUNT SLOT FED BY A RESONANT OFFSET RIDGE IRIS (Atty. Docket No. PD 96233) assigned to the assignee of the present invention and incorporated by reference herein.

The unique design of the present invention is facilitated by the use of the compact transformers 24 that have efficient tuning mechanisms (as discussed more fully below) that obviate the need to add additional transformer line lengths to effectively tune the antenna for excellent performance. This effectively minimizes the height of the antenna 10.

Figure 2:
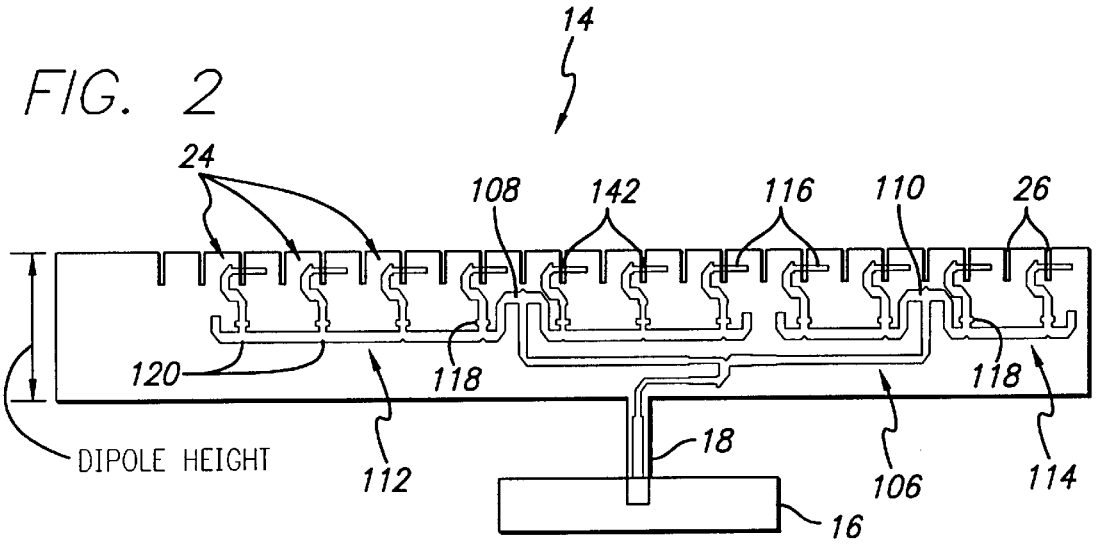
FIG. 2 is a more detailed diagram of a dipole card of the antenna of FIG. 1 showing quarter-wave transformers and a feed waveguide and probe.

FIG. 2 is a more detailed diagram of a dipole card 14 of the antenna 10 of FIG. 1 showing quarter-wave transformers 24, the feed waveguide 16, and the coupled stripline probe 18. The feed waveguide 16 and probe 18 are connected to a stripline feed circuit 106. The stripline feed circuit 106 is in turn connected to a first stripline 108 and a second stripline 110 in a first dipole radiating circuit 112 and a second dipole radiating circuit 114, respectively. Each dipole radiating circuit, 112 and 114 includes a plurality of stripline quarter-wave transformers 24. Each quarter-wave transformer 24 has a corresponding slotline radiating element 116 for radiating electromagnetic energy. The quarter-wave transformers 24 are unique in that they contain rectangular tuning tabs 118 in the sides of the quarter-wave transformers 24. The first and second dipole striplines 108 and 110 are unique in that they contain a triangular or v-shaped tuning notch 120 at the base of each quarter-wave transformer 24.

With reference to FIGS. 1 and 2, in transmission mode, each dipole card 14 in the array 12 is excited by a standing wave sent along the probe 18 from the feed waveguide 16. Each dipole card 14 has radiating feed points 142. The excitation of each radiating element 116 is controlled by the width of the corresponding stripline transformer 24. The tabs 118 and notches 120 on the transformers 24 compensate for junction reactance and radiation phase errors. The notches 120 and tabs 118 allow the antenna radiator equivalent circuit element to look purely shunt to the stripline feed network that includes the stripline feed circuits 108, 110, 106, and 18.

The feed waveguide 16 supplies a standing wave that is transferred to the dipole card circuit 14 via the coupled stripline probe 18. The stripline probe 18 then provides input electromagnetic energy in response thereto to the stripline feed circuit 106. The stripline feed circuit 106 in turn provides input electromagnetic energy to the first stripline 108 and the second stripline 110.

As the electromagnetic energy travels along the striplines 108 and 110, any undesirable insertion phase shifts or errors caused by the striplines 108 and 110 are removed or compensated for via the v-shaped notches 120. The notches 120 are located in the striplines 108 and 110 near and opposite to the inputs to the quarter-wave transformers 24 and protrude into the striplines 108 and 110 toward the quarter-wave transformers 24.

Electromagnetic energy traveling up the quarter-wave transformers 24 may encounter junction effects due to junction reactance and other phenomena that may cause radiation phase errors and/or power loss. The radiation phase errors are efficiently eliminated via the tuning tabs 118. The sizes and positions of the tabs 118 are adjusted to eliminate phase errors for a given signal environment and arrangement of quarter-wave transformers 24.

With the addition of the tuning notches 120 and the tuning tabs 118, the position of the phase center of the antenna 10 of FIG. 1 is easily controlled and focused without the need to extend the lengths of antenna transformers. Use of the tuning notches and tabs allows one ordinarily skilled in the art to taper antenna sidelobe levels, null depths, and gain losses.

In the preferred embodiment, the dipole card circuit 14 receives electromagnetic energy although those skilled in the art will appreciate that the dipole card circuit 14 may transmit electromagnetic energy without departing from the scope of the present invention.

By implementing the dipole card circuit 114 as shown in FIG. 2, the electrically equivalent circuit appears shunt, as opposed to in series, to the stripline feed circuit 106. This allows for a more compact antenna.

The relative sizes of the tuning tabs and notches vary in accordance with radiation phase requirements for a given application. Those ordinarily skilled in the art can easily optimize the sizes of the notches and tabs and the sizes, i.e., widths of the quarter-wave transformers for a given application with the aid of Hewlett Packard's High Frequency Structure Simulator (HFSS) software package.

The feed circuits 18, 106, 108, and 110 and the transformers 24 are easily constructed with conventional materials by those ordinarily skilled in the art.

Figure 2A:
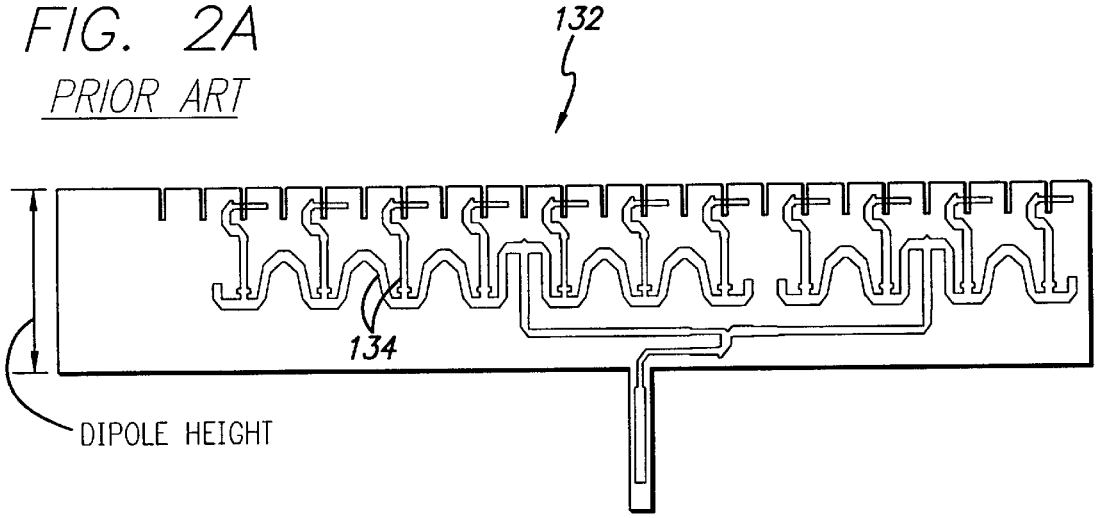
FIG. 2A PRIOR ART
FIG. 2*a* is a diagram of a conventional dipole card.

FIG. 2A is a diagram of a conventional dipole card 132. Additional line lengths 134 required to tune the antenna result in an undesirable increase in dipole height. In addition, the additional length adjustments will not result in a properly shunt circuit element. This results in relatively degraded sidelobe levels, gain, and so on. As a result, the conventional dipole card will have inferior performance. The dipole card of the present invention (see FIG. 2) employing notches and tabs yields superior performance.

Figure 3:
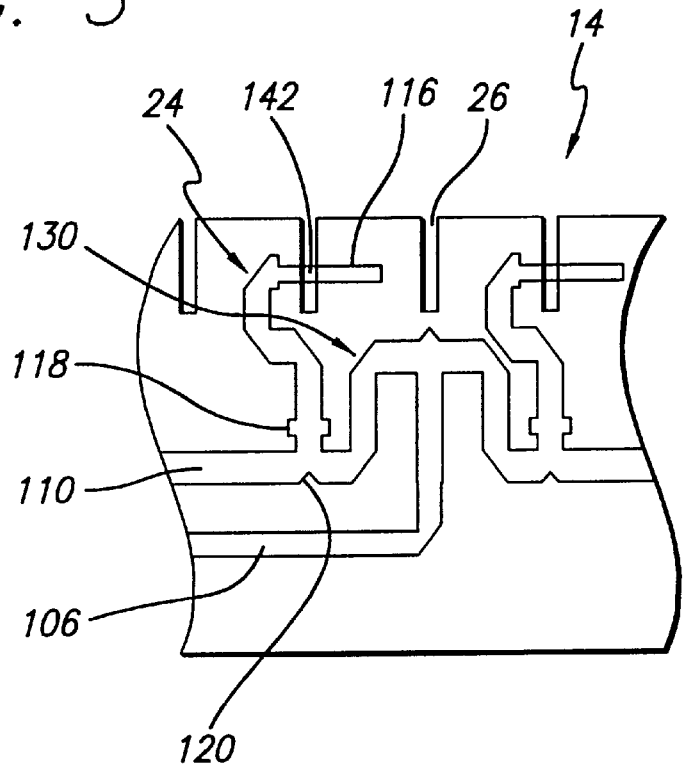
FIG. 3 is a close-up view of the dipole card of FIG. 2 showing a quarter-wave transformer and a unique combination of tabs and a notch.

FIG. 3 is a close-up view of the dipole card 14 of FIG. 2 showing a quarter-wave transformer 24 and a unique combination of tabs 118 and the notch 120. The stripline feed circuit 106 feeds the stripline 110 that then feeds the transformer 24. A bend 130 in the stripline 110 helps to further optimize the use of available space. The tabs 118 in the side of the transformer 24 near the base of the transformer 24 facilitate the removal of radiation phase errors from electromagnetic energy radiated or received via the transformer 24 and corresponding radiation element 116. The notch 120 facilitates the removal of insertion phase errors. The width of the transformer 24 determines the magnitude of radiation output from the radiation element 116 or received to the radiation element 16 when operating in receive mode.

The feed point 142 of the radiation element 116 is located in the feed slot 26. The feed slot 26 is a break in the ground plane of the dipole card 14. The radiation element 116 is a slotline.

Figure 4:
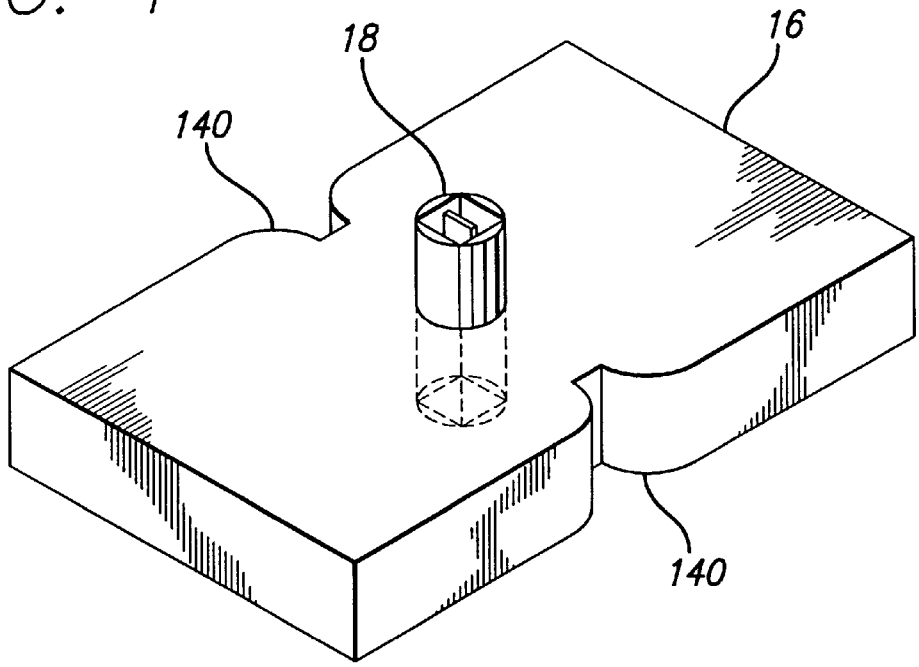
FIG. 4 is a more detailed diagram of the feed waveguide and probe of FIG. 2.

FIG. 4 is a more detailed diagram of the feed waveguide 16 and the stripline probe 18 of FIG. 2. The feed waveguide 16 includes inductive tuning indentations 140 in the walls of the waveguide 16. The constructions of feed waveguides and accompanying probes are well known in the art.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

Accordingly,

What is claimed is:

1. A compact high-performance antenna comprising:

waveguide means for providing or receiving electromagnetic energy;

feed means for providing or receiving said electromagnetic energy to or from said waveguide means;

radiating means for providing or receiving said electromagnetic energy to or from said feed means;

insertion phase means for compensating for insertion phase errors in said electromagnetic energy; and radiation phase means for compensating for radiation phase errors in said electromagnetic energy.

2. The invention of claim 1 wherein said antenna is a dipole antenna.

3. The invention of claim 2 wherein said antenna includes an array of dipole cards.

4. The invention of claim 3 wherein said radiating means includes first and second radiating circuits included in each of said dipole cards.

5. The invention of claim 3 wherein said first and second radiating circuits include a plurality of transformers.

6. The invention of claim 5 wherein said transformers are quarter-wave transformers.

7. The invention of claim 5 wherein said transformers are stripline transformers.

8. The invention of claim 5 wherein one or more of said plurality of transformers includes one more tabs for tuning out radiation phase errors, capacitance effects, and/or junction effects.

9. The invention of claim 8 wherein said one or more tabs is two rectangular tabs.

10. The invention of claim 5 wherein said feed means includes notches near the bases of said transformers for compensating for insertion phase errors.

11. The invention of claim 5 wherein said transformers are arranged so that an equivalent circuit of said radiating means appears shunt to an equivalent circuit of said feed means.

12. The invention of claim 5 wherein said feed means includes a stripline feed circuit.

13. The invention of claim 12 wherein said transformers are connected to said stripline circuit.

14. The invention of claim 5 wherein said feed means includes one or more slotline circuit elements connected to one or more of said transformers.

15. The invention of claim 1 wherein said waveguide means includes a feed waveguide and a probe.

16. The invention of claim 15 wherein said feed waveguide is a standing wave waveguide feed.

17. The invention of claim 15 wherein said feed waveguide is an iris excited slotted waveguide.

18. The invention of claim 15 wherein said feed waveguide includes indentations for inductive tuning.

19. The invention of claim 1 further including gain means for controlling the magnitude of said electromagnetic energy.

20. The invention of claim 19 wherein said gain means includes one or more transformers, said magnitude a function of the sizes of said one or more transformers.

21. The invention of claim 1 wherein said radiation phase means includes one or more transformers.

22. The invention of claim 21 wherein said radiation phase means further includes one or more tabs in said one or more transformers.

23. The invention of claim 22 wherein said one or more tabs are rectangular and located in a side or sides of said one or more transformers.

24. The invention of claim 1 wherein said insertion phase means includes one or more notches in said feed means.

25. The invention of claim 24 wherein said notches are v-shaped and located near a base or bases of one or more transformers included in said radiation means.

26. A compact high-performance antenna comprising:

one or more waveguides for providing input electromagnetic energy;

a feed circuit for receiving said input electromagnetic energy and providing feed electromagnetic energy in response thereto;

one or more radiating elements connected to said feed circuit, said one or more radiating elements including one or more transformers; and one or more tuning tabs located in the sides of said one or more transformers for adjusting the phase of said feed electromagnetic energy and radiating in-phase electromagnetic energy in response thereto.

27. The invention of claim 26 further including one or more tuning notches located in said feed circuit.

28. A compact high-performance antenna comprising:

a waveguide;

a probe connected to said waveguide;

a feed circuit connected to said waveguide via said probe;

a radiating element connected to said feed circuit, said radiating element connected to a transformer;

a tuning tab located in a side of said transformer; and a tuning notch in said feed circuit near the base of said transformer.

* * * * *